US005345628A

United States Patent [19]

Keefer

[11] Patent Number: 5,345,628

[45] Date of Patent: Sep. 13, 1994

[54] WATERBED MATTRESS WITH TETHERED WAVE MOTION-INHIBITING INSERTS

[75] Inventor: Donald W. Keefer, Pasadena, Md.

[73] Assignee: Classic Corporation, Jessup, Md.

[21] Appl. No.: 32,008

[22] Filed: Mar. 16, 1993

[51] Int. Cl.[5] ..... A47C 27/08

[52] U.S. Cl. ..... 5/450; 5/451; 5/920; 156/250

[58] Field of Search ..... 5/451, 450, 449, 919–921, 5/932; 156/250

[56] References Cited

U.S. PATENT DOCUMENTS

| | | | |
|---|---|---|---|
| 184,487 | 11/1876 | White | 5/451 |
| 779,576 | 1/1905 | Berryman | 5/451 |
| 2,859,455 | 11/1958 | Koenigsberg | 5/481 |
| 3,456,270 | 7/1969 | Weinstein et al. | 5/451 |
| 4,247,962 | 2/1981 | Hall | 5/451 |
| 4,345,348 | 8/1982 | Hall | 5/451 |
| 4,551,873 | 11/1985 | Hall | 5/451 |
| 5,050,257 | 9/1991 | Johenning | 5/450 |
| 5,062,170 | 11/1991 | Johenning | 5/450 |

*Primary Examiner*—Alexander Grosz
*Attorney, Agent, or Firm*—Finnegan, Henderson, Farabow, Garrett & Dunner

[57] ABSTRACT

To anchor an insert in proper wave motion-inhibiting position within a waterbed mattress, a rectangular, top vinyl sheet is patterned with corner sections which, upon formation of the mattress, are folded to provide a pair of inwardly extending anchoring flaps. Endless vinyl tethers are looped through apertures in the flaps to provide a secure four-corner anchorage of the inert to the mattress. Several forms of tether loop connections to an insert are disclosed for different constructions of wave motion-inhibiting inserts.

15 Claims, 3 Drawing Sheets

WATERBED MATTRESS WITH TETHERED WAVE MOTION-INHIBITING INSERTS

BACKGROUND OF THE INVENTION

1. Field of the Invention

The present invention relates to waterbed mattresses and particularly to such mattresses having inserts disposed within the mattress to inhibit wave motion of the water filling the mattress.

2. Description of the Prior Art

The growth of waterbed sales in the marketplace over the past decade is directly attributable to the reduction of wave motion and increased surface firmness of modern water mattresses. To address the wave motion problem, manufacturers have developed wave motion inhibiting provisions of various types, of which the most utilized and effective of these inserts is the so-called "fiber" insert. Fiber inserts typically consist of one or more layers of bonded polyester fiber batt. Multiple layers of fiber are generally held together with ties of twine, strips of vinyl film, or sometimes plastic or aluminum rivets.

Such mattress constructions generally present little or no problem unless the mattress is moved when partially filled with water, i.e., while in the process of draining or filling the mattress. On such occasions, the heavy, wet fiber insert can readily slide into a pile at an end or side of the vinyl mattress shell. If this happens, it is virtually impossible to straighten out the crumpled insert, and the mattress is essentially ruined. Also, if the mattress is subject to a sudden and intense impact, the resulting wave energy can push the fiber insert out of position and into a lump. Again, the end result is usually a dysfunctional mattress.

To combat this problem it has been proposed to somehow anchor these free-floating inserts to the vinyl mattress shell. One approach has been to anchor the inserts to either integral tabs extending from bottom seams of the vinyl mattress shell or to molded, semi-rigid polyvinylchloride (PVC) flanged eyelets sealed to the walls of the vinyl shell.

The problem of anchoring free-floating objects in a water mattress is one of long standing. For example, White, in U.S. Pat. No. 184,487, discloses straps and buckles to hold "sacks" of water together to provide a stable bed surface. Berryman, in U.S. Pat. No. 779,576, uses a similar approach with "tubes" of water. In both of these patents, the applications of straps, ties, etc. are to the exterior of water containers.

Koenigsberg, in U.S. Pat. No. 2,859,455, discloses binding edges of a foam mattress to the perimeter of a foam mattress cover to prevent relative movement between the mattress and cover. Weinstein et al., in U.S. Pat. No. 3,456,270, discloses an air bladder held in position over a water bladder by securing the air bladder edges to upstanding sides of a foam base.

U.S. Pat. Nos. 4,247,962; 4,345,348; and 4,551,873 to Hall disclose various applications of straps sealed to various parts of the vinyl mattress shell for use in anchoring floating baffle inserts in fixed positions within the water mattress. In addition, Johenning, U.S. Pat. No. 5,062,170, discloses tying baffle inserts to molded eyelets affixed to reinforced mattress corner pieces.

All of the foregoing examples have one or more inherent drawbacks. Any type of anchoring element that is sealed to any part of the vinyl mattress shell creates a weak spot which, if stressed, can result in leakage. Vinyl straps and twine ties have a tendency to slip or loosen over time since a slippery film will build up on internal components of a water mattress even with periodic additions of recommended water treatment compounds. Tabs integrally formed with the vinyl sheets are very wasteful of material as significantly larger pieces of vinyl are required to provide for the tabs. In addition, such tabs are typically located very close to sealed seams to minimize material usage, which creates high stress areas due to the fact that the seams at the bottom of the mattress are held rigidly in place by the weight of the water in the mattress. Consequently there is a propensity for ruptures to occur at the seam areas when the tabs are stressed.

In addition, the introduction of molded, thicker and more robust components into the dielectric heat sealing process with 20 mil. calendered PVC mattress sheeting can pose serious problems due to formulation differences and fusing temperature variations attributable to the differences in the materials and thicknesses of materials involved. Semi-rigid, molded eyelets, for example, have very little if any ability to flex or stretch and thus are unable to absorb any significant stress. As a result, the majority of any stress will tend to be transferred to the seams where the eyelets are sealed to the vinyl mattress shell, and leakage can occur. Another problem is the manner in which the tether tie or strap attaches to a fiber insert. In many instances, the tether strap, band, cord, etc. is passed through holes in the fiber layer(s). Fiber batts do not generally possess significant tensile strength near the edges and can readily permit any type of restricting tie to pull or tear out with minimal stress being exerted. While this does not create the potential for leakage, the insert is no longer properly anchored in place, thus creating the insert dislocation problems mentioned above.

SUMMARY OF THE INVENTION

Accordingly, the present invention is directed to a waterbed mattress constructed in a manner to substantially obviate the problems of the prior art considered above. To these ends, the present invention provides a waterbed mattress having rectangular top and bottom sheets of elastomeric material. The top sheet includes a central portion bounded by opposed side and end marginal portions and conjoining corner sections, with each corner section configured to provide at least one flap having a tether aperture.

Upon formation of the waterbed mattress to create a watertight chamber, the top and bottom sheets are sealed together with the bottom sheet providing a mattress bottom wall and the top sheet is folded such that the central portion provides a mattress top wall and the side and end marginal portions provide mattress side and end walls conjoined by the corner sections with the flaps folded inwardly to extend into the chamber. An exterior corner patch is sealed over each corner section. The water mattress further includes a rectangular insert disposed in the chamber to suppress wave action of the water filling the chamber, and the insert is retained in a predetermined position within the chamber by tethers connected with the insert and looped through the flap apertures.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of the specification to illustrate several embodiments of the invention and together with the description serve to explain the principles of the invention.

BRIEF DESCRIPTION OF THE DRAWINGS

Like reference numerals refer to corresponding parts throughout the several views of the drawing.

DETAILED DESCRIPTION

Figure 1:
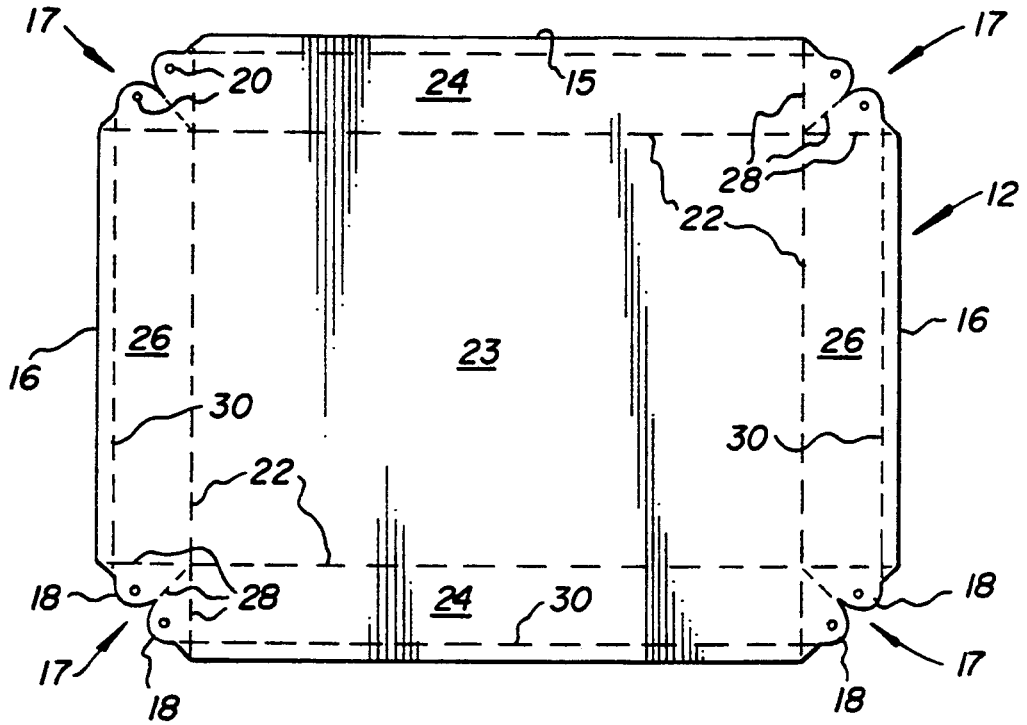
FIG. 1 is a plan view of an elastomeric film patterned in accordance with the present invention to provide a top sheet for a waterbed mattress.
Figure 2:
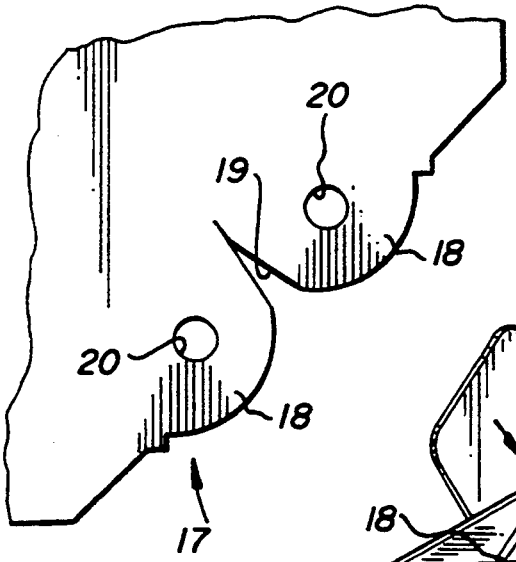
FIG. 2 is an enlarged plan view of one of the four corner sections seen in the top sheet of FIG. 1.
Figure 5:
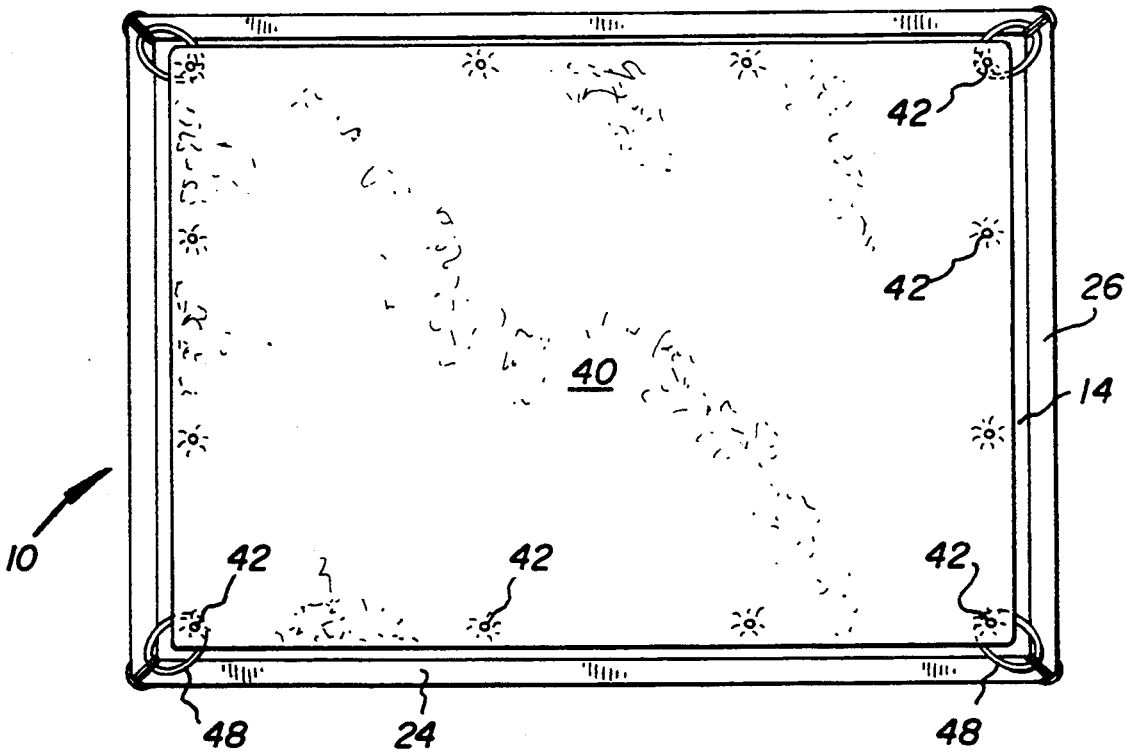
FIG. 5 is a plan view of a waterbed mattress constructed in accordance with the present invention, with the mattress top wall removed.

The waterbed mattress of the present invention, generally indicated at 10 in FIG. 5, includes a top sheet 12 (FIG. 1) in the form of a calendared elastomeric film of a suitable plastic material, such as flexible polyvinylchloride (PVC) and a bottom sheet 14 (FIG. 3) of the same material. The top sheet is cut from a rectangular blank of suitable thickness, e.g., 20 mils. to provide opposed, parallel side edges 15 and opposed, parallel end edges 16. Each corner of the blank is marked and cut in accordance with a corner template (not shown) to create a configured corner section 17 having a pair of adjacent flaps 18 separated by an inwardly extending slit 19, as best seen in the enlargement of FIG. 2. Each flap includes a centrally located aperture 20. Dash lines 22 demarcate a rectangular central section 23 that will ultimately provide a top wall of the finished waterbed mattress and also opposed side 24 and end 26 marginal panels that will ultimately provide opposed side and end walls, respectively, of the finished mattress.

To form mattress 10, marginal panels 24 and 26 are folded downwardly along dash lines 22 and corner sections 17 are folded inwardly generally along diagonal dash lines 28, such that flaps 18 of each corner section assumed lapped relationships. Portions of the sheet edges 15, 16 are folded inwardly along fold lines 30 to lap with edge portions of rectangular bottom sheet 14. The lapped edge portions of the top and bottom sheets are dielectrically heat sealed together only in the immediate vicinity of corner section 17, as indicated at 32 in FIG. 3. Each partially formed corner section is then draped over a mandrel type sealing die (not shown) with flaps 18 disposed in an open central portion of the die. A decorative corner patch 36 (FIG. 3) of a suitable form, such as diamond-shaped, is dielectrically heat sealed over the exterior of each corner section. The corner patch bonding seam with the side and end panels 24 and 26 is illustrated at 38 in FIG. 3. The corner patch is preferably of the same material as the top and bottom sheets, and of a somewhat larger gauge, e.g., 36 mils .

At this point, the mattress shell, comprised of the top and bottom sheets, is fairly well defined by the seam joints between the top and bottom sheets and bonded corner patch 36 at each corner section. The unbonded sections of the top and bottom sheet edge portions are then separated sufficiently to introduce a wave motion inhibiting insert, generally indicated at 40 in FIGS. 3 and 5. This insert is comprised of long and typically plural rectangularly shaped layers of a fibrous material, such as bonded polyester fiber batt. The insert may include, in addition to polyester fiber batt, layers of other materials such as polyurethane foam, closed cell floatation media, etc. As seen in FIG. 5, the dimensions of the insert 40 are such that the insert edges are in closely spaced relation to the mattress side and end walls constituted by top sheet marginal panels 24 and 26, respectively. It now remains to securely anchor the insert in the position shogun in FIG. 5.

Figure 3:
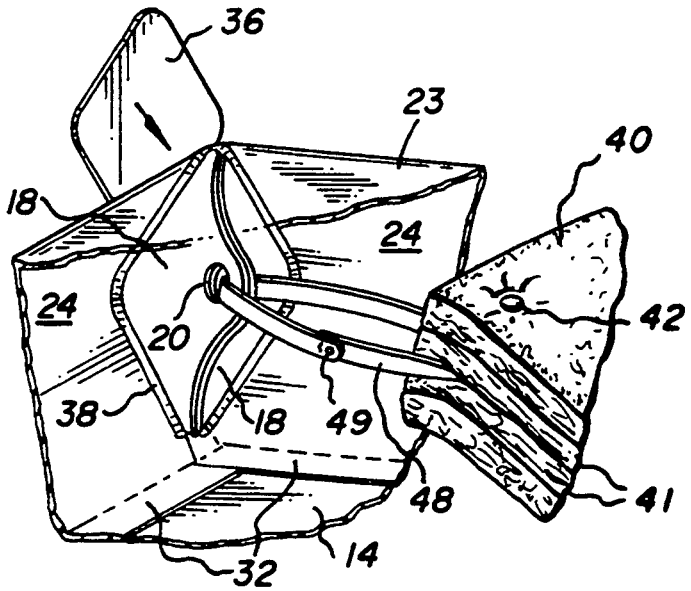
FIG. 3 is a fragmentary perspective view, partially broken away and exploded, of the internal anchoring provisions for wave motion inhibiting inserts, in accordance with one embodiment of the present invention.
Figure 4:
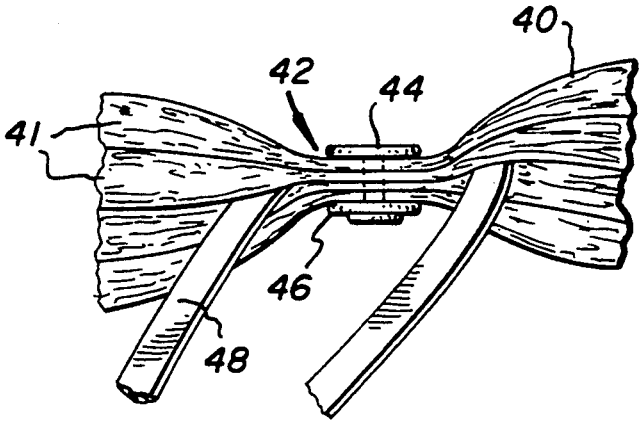
FIG. 4 is a fragmentary elevational view further illustrating the connection of a tether loop to the multilayer insert in FIG. 3.

To this end and in accordance with one embodiment of the present invention seen in FIGS. 3–5, insert 40 is comprised of multiple, superimposed layers 41 of fibrous material. Adjacent each corner of the insert, a fastener, generally indicated at 42, is vertically inserted through the multiple layers at a point equally spaced from the insert corner edges by a distance of, for example, two to four inches. In accordance with a feature of the present invention, the fastener is a double-headed fastener such as a rivet having an enlarged head 44 at one end and an enlarged washer 46 swaged to the other rivet end, as seen in FIG. 4. The distance between the rivet head and the washer is such as to produce a high degree of compaction of the fibrous insert layers in the vicinity of fasteners 42, as illustrated in FIG. 4. By virtue of this compaction, the tensile strength of the insert fibrous material is dramatically increased, such as to prevent the fasteners 42 from being torn out of the insert corners. As seen in FIG. 5, fasteners 42 may also be utilized at perimeter locations between the insert corners to ensure complete registry and integrity of the multiple insert layer construction.

Now to anchor multilayer insert 40 to the mattress shell, tethers in the form of bands or straps 48 of a suitable plastic material, such as flexible, low elongation type polyvinylchloride (PVC) are utilized. As seen in FIGS. 3–5, a strap 48 is inserted between insert layers 41 and looped around a fastener 42 and through apertures 20 of both flaps 18 of a corner section 17. The ends of the strap are lapped and dielectrically heat sealed together, as indicated at 49 in FIG. 3, to create a strap loop. This tethering is repeated at each corner section to complete a secure, four-corner connection or anchoring of insert 40 to the mattress shell corner sections 17, as seen in FIG. 5. By using plastic tethering straps heat sealed into endless loops, knots or separate cinches, that are susceptible to loosening and snagging over time, are avoided. The added strength of the compacted fibrous insert material ensures reliable tether connections to insert 40. Similarly, the dual tethering flaps 18 of each corner section ensure reliable tether connections to the mattress shell.

As seen in FIG. 3, flaps 18 involve considerable sheet material which, in addition to absorbing tensile anchoring forces, effectively distributes such forces over the dramatically increased length of the diamond-shaped corner seams 38. Thus, corner seam failures from insert anchorage stress are avoided. It is also to be noted that the enlarged flaps 18 are created in corner sections 17 of the top sheet blank seen in FIG. 1, which in conventional water mattress designs are wastage. Thus, the dimensions of the top sheet blank are not increased to provide for the integral tether flaps 18. While it is preferable that the blank seen in FIG. 1 be used as a top sheet to avoid the appearance of seams 32 around the top perimeter of the mattress, the illustrated top sheet blank could be used to provide the mattress bottom, side and end walls.

Figure 6:
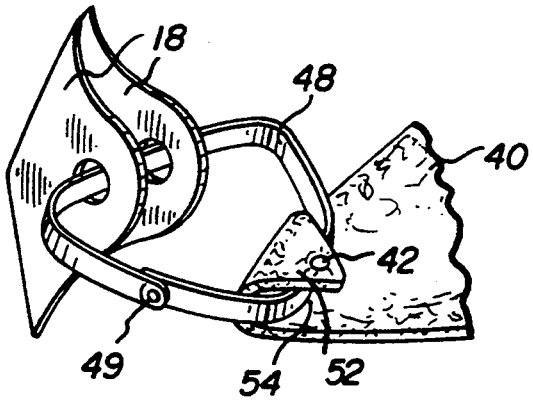
FIG. 6 is a fragmentary perspective view illustrating an alternative anchoring provision in accordance with the present invention, which is utilized when a wave motion inhibiting insert is comprised of a single layer of fibrous sheet material.

When the wave motion inhibiting insert is comprised of one or a small number of inserts, the tether connection to the insert corners is effected in the manner illustrated in FIG. 6. The insert corners 52 are folded over and fastened down with fasteners 42 to create locked folds 54 through which the tether straps 48 are looped to effect four-corner tether connections to the insert.

Figure 8:
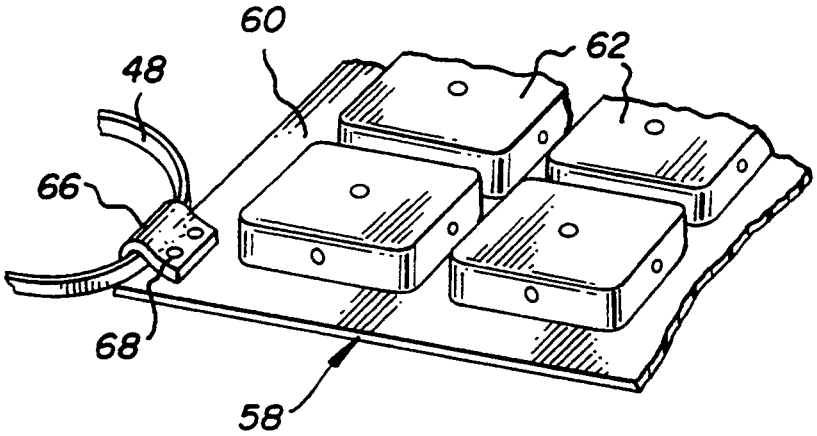
FIG. 8 is a fragmentary perspective view illustrating the anchoring provision of FIG. 7 as applied to a sink sheet insert.
Figure 7:
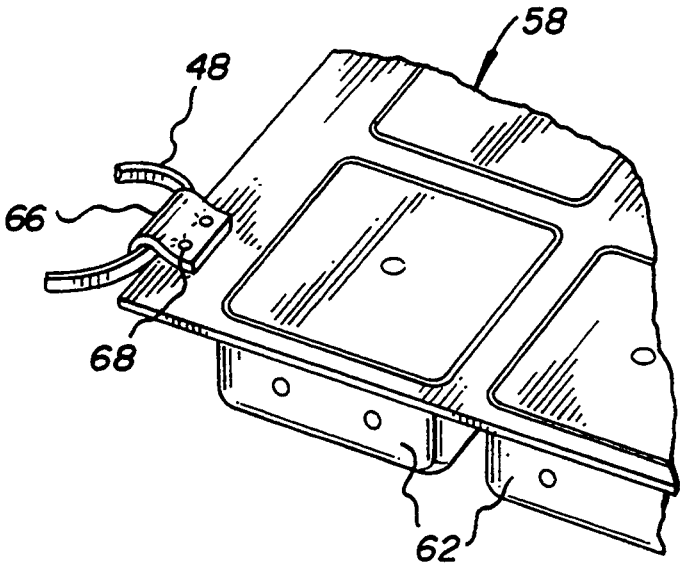
FIG. 7 is a fragmentary perspective view illustrating an alternative anchoring provision utilized when the wave motion inhibiting insert is of a float sheet type.

Rather than fibrous batt inserts, wave motion inhibiting inserts can be of the construction illustrated in FIGS. 7 and 8. Such inserts, generally indicated at 58, comprise a rectangular sheet 60 of elastomeric film to which perforated pockets 62 filled with buoyant material, such closed cell polyethylene, are affixed at one side in distributed relation. If insert 58 is oriented with pockets 62 on the underside of sheet 60, as illustrated in FIG. 7, the insert is termed a "float sheet". If the inert orientation is reversed as seen in FIG. 8, a so-called "sink sheet" is provided. Regardless of the orientation of insert 58, tethering in accordance with the present invention is accomplished by folding pads 66 about edges of sheet 60 adjacent each corner and clamping the pad ends to the sheet using fasteners 68, which may be of the rivet-washer type 42 seen in FIG. 4. These pads may be one or several layers of the fibrous material utilized for insert 40. Tether straps 48 are looped through the locked folds provided by pads 66 to effect four-corner tether connections to inert 58. The strap loops also extend through flap apertures 18 to anchor the insert corners to the mattress shell corner sections 17.

After completing insert tethering, seams 32 (FIG. 3) are then completed from corner to corner by dielectrically heat sealing the lapped edge portions of the top and bottom sheets to create a chamber to be filled with water. It is seen that tethering provisions of the present invention are effective to reliably withstand forces tending to dislocate a wave motion inhibiting insert. Thus, failure of the tethering connections and ruptures of the mattress shell are avoided in an effective and cost-efficient manner. Proper insert position within the water mattress is thus effectively sustained over a long service life.

It will be apparent to those skilled in the art that various modifications and variations can be made in the constructions set forth without departing from the spirit and scope of the present invention. Thus, it is intended that the present invention cover modifications and variations thereof that come within the scope of the appended claims and their equivalents.

I claim:

1. A waterbed mattress comprising, in combination:

at least one sheet of film material having integral marginal panels and sheet portions between adjacent said marginal panels configured to provide at least one flap having a tether aperture, said marginal panels being folded to provide sides of a mattress shell defining a water-tight chamber, and said sheet portions being folded inwardly to project said flaps into the chamber;

an insert disposed in the chamber to inhibit wave motion within the chamber; and tethers looped through said tether apertures of said flaps and connected with said insert to retain said insert in position within the chamber.

2. The waterbed mattress defined in claim 1, which further includes exterior patches sealed to said marginal panels in overlying relation with said sheet portions.

3. The waterbed mattress defined in claim 1, wherein each said sheet portion is configured to provide a pair of said flaps, each said sheet portion is folded inwardly to position said flaps of each said pair in lapping relation with said tether apertures in substantial registry.

4. The waterbed mattress defined in claims 3, wherein each said sheet portion is configured with said flaps of said pair being separated by a slit.

5. The waterbed mattress defined in claim 1, which includes a second sheet of film material joined with said one sheet along respective lapped edge portions of said second sheet and said marginal panels to create said mattress shell.

6. The waterbed mattress defined in claim 5, which further includes exterior patches having perimeter edge portions sealed along an endless seam to said marginal panels in overlying relation with said sheet portions.

7. The waterbed mattress defined in claim 6, wherein said one sheet includes a rectangular central portion bounded by said marginal panels, said central portion, said marginal panels, and said second sheet respectively providing a top wall, side and end walls, and a bottom wall of said mattress shell, said flaps located at corners of said mattress shell.

8. The waterbed mattress defined in claim 1, wherein said insert includes multiple layers of fibrous material and fasteners extending through said insert layers at locations proximate said flaps, said tethers extending between said insert layers and looped around said fasteners to anchor said insert to said mattress shell.

9. The waterbed mattress defined in claim 8, wherein said fasteners are headed fasteners dimensioned to produce substantial localized compaction of said insert layers.

10. The waterbed mattress defined in claim 1, wherein said tethers are strips of plastic film material having opposed ends lapped and heat sealed together to provide continuous loops.

11. The waterbed mattress defined in claim 1, wherein said insert is in the form of at least one rectangular sheet of fibrous material, said sheet having corner portions folded over and fastened to provide locked folds through which said tethers are looped.

12. The waterbed mattress defined in claim 1, wherein said insert includes an insert sheet having four corners and floatation units affixed to an upper surface of said insert sheet, and anchoring pads having opposed ends affixed to said insert sheet to provide anchoring loops adjacent each of the insert four corners, said tethers extending through said anchoring loops.

13. The waterbed mattress defined in claim 1, wherein said insert includes an insert sheet having four corners and floatation units affixed to a lower surface of said insert sheet, and anchoring pads having opposed ends affixed to said insert sheet to provide anchoring loops adjacent each of the insert four corners, said tethers extending through said anchoring loops.

14. A method of manufacturing a waterbed mattress comprising the steps of:

cutting a first sheet of plastic film material to include a central portion of a size corresponding to a rectangular top wall of the mattress, marginal panels surrounding the central portion, and corner sections interconnecting adjacent marginal panels, each corner section including at least one flap, each flap having an aperture;

cutting a second sheet of plastic film material to a size corresponding to a rectangular bottom wall of the mattress;

folding the marginal panels into potential side and end walls of the mattress;

folding the corner sections to project the flaps inwardly from the marginal panels;

lapping edge portions of at corners of the second sheet with edge portions of the corner sections;

sealing the lapped edge portions of the second sheet corners and the corner sections in joined relation;

positioning a rectangular wave motion-inhibiting insert between the first and second sheets;

inserting separate strips of plastic film material through the apertures of the pair of flaps of each corner section and through an anchoring provision at each corner of the insert;

sealing lapped opposed ends of each strip into an endless loop;

lapping edge portions of the marginal panels with edge portions of the second sheet between the corners thereof; and sealing the lapped edge portions to create a watertight mattress shell with the insert anchored in a predetermined position within the mattress by the tethers.

15. The method defined in claim 14, which further includes the step of sealing a separate exterior corner patch over each inwardly folded corner section.

* * * * *